United States Patent [19]

Meisner et al.

[11] Patent Number: 4,855,971

[45] Date of Patent: Aug. 8, 1989

[54] TIME ADJUSTMENT ARRANGEMENT FOR DIGITAL DISPLAYS

[75] Inventors: Alfred Meisner; Karlheinz Hammelsbacher, both of Nuremberg, Fed. Rep. of Germany

[73] Assignee: Diehl GmbH & Co., Nuremberg, Fed. Rep. of Germany

[21] Appl. No.: 69,509

[22] Filed: Jul. 2, 1987

[30] Foreign Application Priority Data

Jul. 5, 1986 [DE] Fed. Rep. of Germany ..... 3622681

[51] Int. Cl.[4] ..... G04C 9/00

[52] U.S. Cl. ..... 368/188; 368/69; 368/70

[58] Field of Search ..... 368/188, 62, 69, 185, 368/70, 186, 187, 189

[56] References Cited

U.S. PATENT DOCUMENTS

| | | | |
|---|---|---|---|
| 4,209,973 | 7/1980 | Maezawa | 368/84 |
| 4,312,055 | 1/1982 | Noble | 368/82 |
| 4,415,273 | 11/1983 | Hoffman et al. | 368/68 |

*Primary Examiner*—Bernard Roskoski

*Attorney, Agent, or Firm*—Scully, Scott, Murphy & Presser

[57] ABSTRACT

An electronic timepiece or clock with a digital display, and with an arrangement for the setting or adjustment of the minutes and/or hour display through either a short or lengthier depression of a timing push button. A single timing push button is provided on the timepiece for the forward and for the backward setting of the display. The single timing push button also serves for the rapid setting of the display. In this connection, the arrangement for the setting of the minutes and/or hour display provides for a distinction between a short depression of the timing push button ($t<t_1$) and a lengthier depression of the timing push button ($t>t_1$).

5 Claims, 6 Drawing Sheets

TIME ADJUSTMENT ARRANGEMENT FOR DIGITAL DISPLAYS

BACKGROUND OF THE INVENTION

1. Field of the Invention

The present invention relates to an electronic timepiece or clock with a digital display, and with an arrangement for the setting or adjustment of the minutes and/or hour display through either a short or lengthier depression of a timing push button.

2. Discussion of the Prior Art

Electronic timepieces or clocks of the above-mentioned described type are already known, for example, from the disclosure of German Pat. No. 31 05 067. In that instance, through a short depression of a push button, there the minutes of the digital display are adjusted. At a lengthier depression of this push button, there are adjusted the hours, whereby at the exertion of a continuous pressure against the push button, the setting or adjustment of the display for the hours becomes automatically more rapid.

The disadvantage of an arrangement of that type resides in that the digital display can be adjusted or set in only one direction; namely, forwardly. During the setting of the display, when one overtravels the desired display setting or value, the display must be further forwardly adjusted by almost 24 hours until it is possible to undertake a renewed setting procedure for the display.

For example, from the disclosure of German Laid-Open Patent Appln. No. 25 52 366, it is also known that, through the depression of a push button, at a short actuation it is possible to set the minutes slowly, while for a lengthier pressure on the push button the minutes display can be set rapidly. This arrangement is also subject to the disadvantage that a setting can be carried out with only one push button in a single direction.

Furthermore, from the disclosure of German Laid-Open Patent Appln. No. 28 34 304 it is also known that through the depressing of a first push button there can be undertaken a slow setting of the display, and at an additional depressing of a second push button, the setting can be carried out rapidly. The display is hereby adjusted or set in a forward direction. When, in contrast therewith, the sequence of the actuation of the push buttons is selected in a reverse manner, then a backwards setting of the display can possibly be carried out either slowly or rapidly. This known arrangement affords the advantage of effecting the setting of the digital display in both directions; however, there is encountered the disadvantage that, for this purpose, two push buttons are depressed in a different actuating sequence.

SUMMARY OF THE INVENTION

Accordingly, in contrast with the foregoing, it is an object of the present invention to provide for a further simplification in the adjustment or setting of a digital display.

The foregoing object is inventively achieved in that only a single timing push button is provided on the timepiece for the forward and for the backward setting of the display.

Pursuant to a further modification of the invention, it is contemplated that the single timing push button also serves for the rapid setting of the display.

In accordance with another preferred modification, it is contemplated that the arrangement for the setting of the minutes and/or hour display provides for a distinction between a short depression of the timing push button ($t<t_1$) and a lengthier depression of the timing push button ($t>t_1$).

In a further modification, the above-mentioned arrangement undertakes the backwards setting of the display only when the timing push button is depressed for a short period ($t<t_1$), and the presently following pulse is similarly for a short period ($t<t_l$).

In contrast therewith, a forward setting of the display is undertaken by the arrangement when the timing push button is depressed for a lengthier period ($t>t_1$) and at a continual actuation of the timing push button, after a predetermined time ($t>n.t_1$) a rapid setting of the display, possibly in a plurality of speed increments.

Pursuant to the invention, one second is provided as the predetermined time $t_1$, which serves as the distinguishing criteria in between a short and lengthier actuating period for the timing push button. Naturally, other time periods than one second are possible as distinguishing criteria.

The inventive display setting arrangement is adapted for the utilization thereof in all electronic timepieces or clocks possessing a digital display. The arrangement is also employable as shown in a following described example, for electronic timers, in particular, cooking range timers.

BRIEF DESCRIPTION OF THE DRAWINGS

Reference may now be had to the following detailed description of two exemplary embodiments of the invention, taken in conjunction with the accompanying drawings; in which.

DETAILED DESCRIPTION

Figure 1:
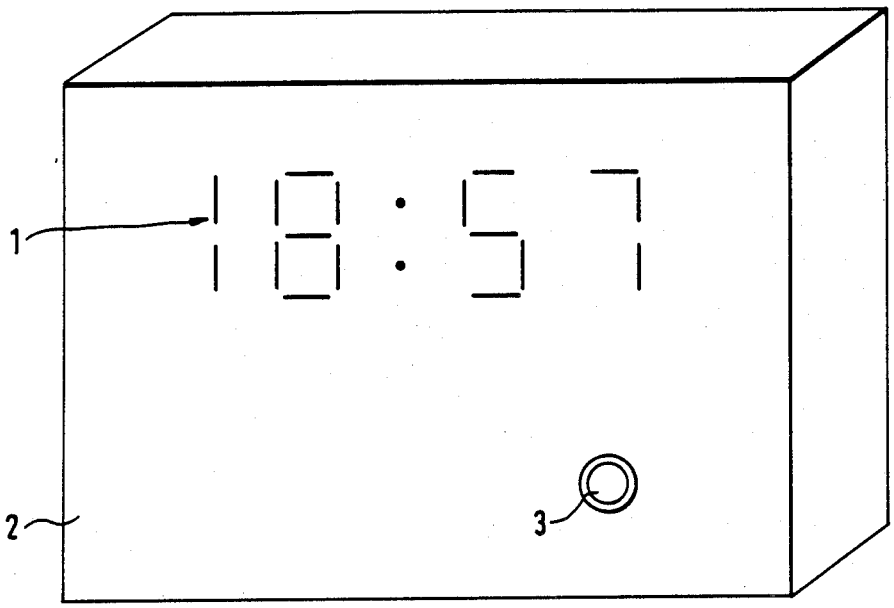
FIG. 1 illustrates, in a schematic representation, the digital display of an electronic timepiece with an actuating push button.

Illustrated in FIG. 1 of the drawings is the schematic representation of the digital display 1 of an electronic timepiece or clock 2. The display is constituted from a seven-segment display with the representation of the minutes and hours. There is provided a timing push button 3, through the actuation of which the timepiece can be set forwardly or backwardly, and whereby a rapid adjustment or setting is provided in the forward direction.

The setting of the display in a positive direction forwardly is carried out in a manner in which the timing push button 3 is actually depressed for longer than one second. Every pressure on the push button produces a displacement or resetting of the display by one minute. At a continual actuation of the timing push button 3, the minute is initially assumed slowly and then incrementally more rapidly. For one specific embodiment of the invention, there are provided a total of 6 speed increments, in which, during the most rapid speed increment, there are undertaken 100 minute displacements during each second. For the actuation of the display in a negative or backward direction, the timing push button 3 is presently actuated only for a short period, in effect, for less than a duration of one second. Hereby, it is important that also the following actuating interval or interruption is presently less than one second. In this instance, the time discriminator in the timepiece recognizes, after the first pulse, that the setting of the display is to be implemented in the backwards direction. Since the setting of the display in the backwards direction is intended to serve for only smaller changes in time, no provision is made for any rapid setting.

In the present case in the same sense, when the time period for an actuation of the push button is to be defined as either greater or less than one second, within the scope of the invention there can also be selected every other expediently appearing period as a discrimination for the setting in either a positive or negative direction.

Figure 2:
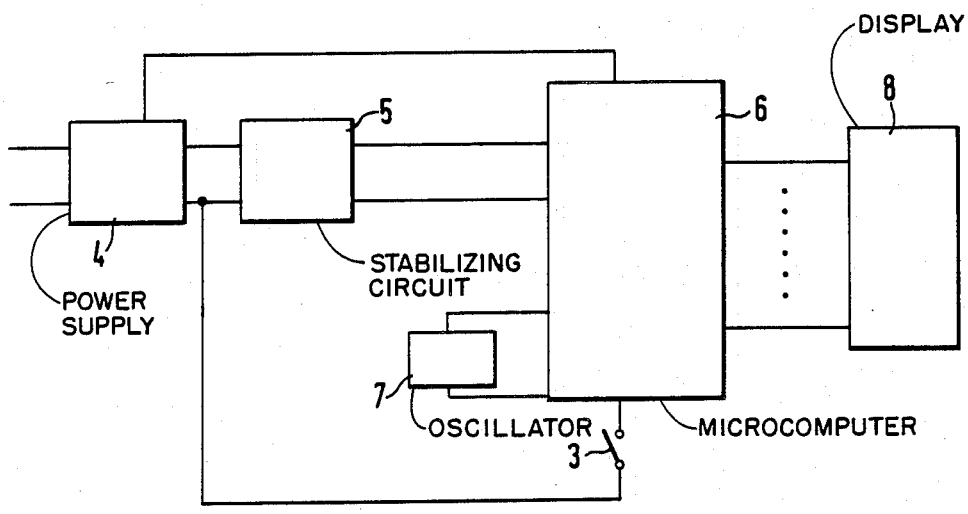
FIG. 2 illustrates a block circuit diagram for an electronic timepiece.

In FIG. 2 of the drawings, there is illustrated the block circuit diagram of an electronic clock, in which there can be ascertained a power supply 4, a stabilizing circuit 5 connected to the output of the power supply, a microcomputer 6, an oscillator 7 which is required for the operation of the microcomputer, digital display 8, as well as, finally, the timing push button 3.

When, in the same manner, the invention is hereinbelow always described in connection with a power supply-operated electronic timepiece or clock understandably, it is also possible to employ the invention for timepiece or clocks which are quartz-operated or also through another suitable oscillator. In such a case, the power supply 4 and upon occasion, the stabilizing circuit 5 can be replaced by a corresponding oscillator, as well as, upon occasion, by a frequency divider, when the frequency division itself is not undertaken in the microcomputer 6.

Figure 3:
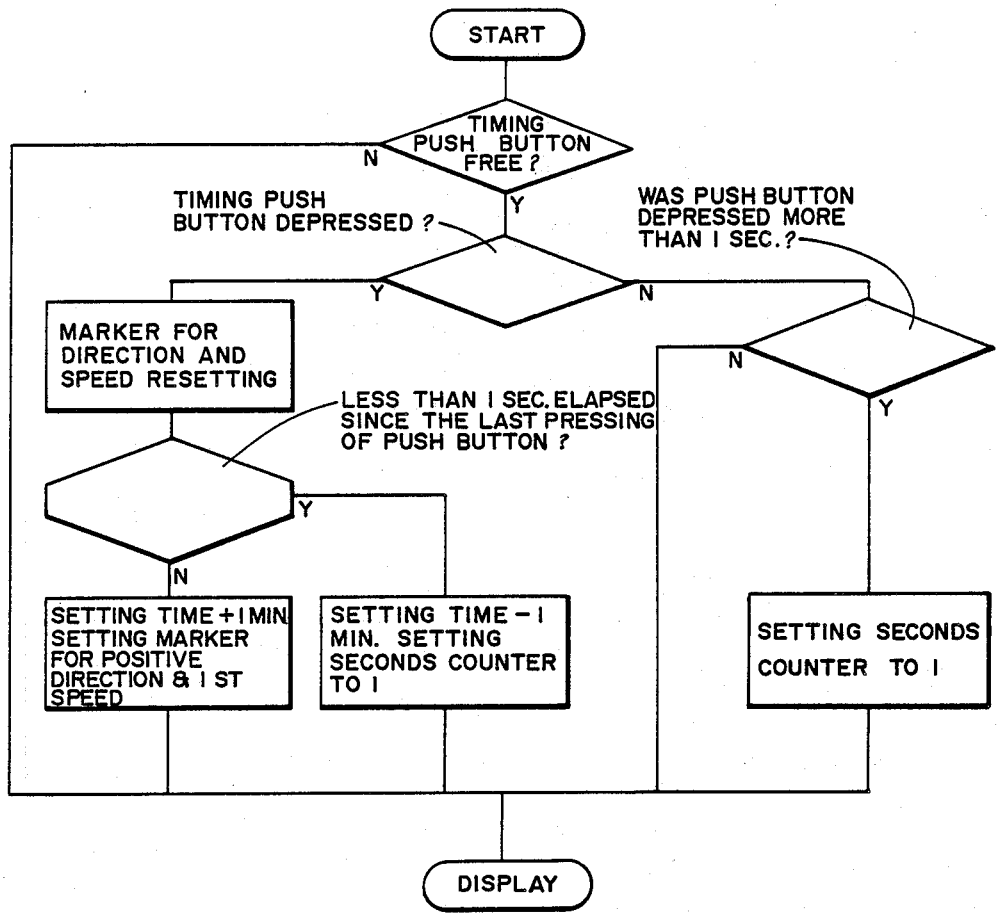
FIG. 3 illustrates a flow chart for the recognition of the positive and for the negative setting direction of the display.
Figure 4:
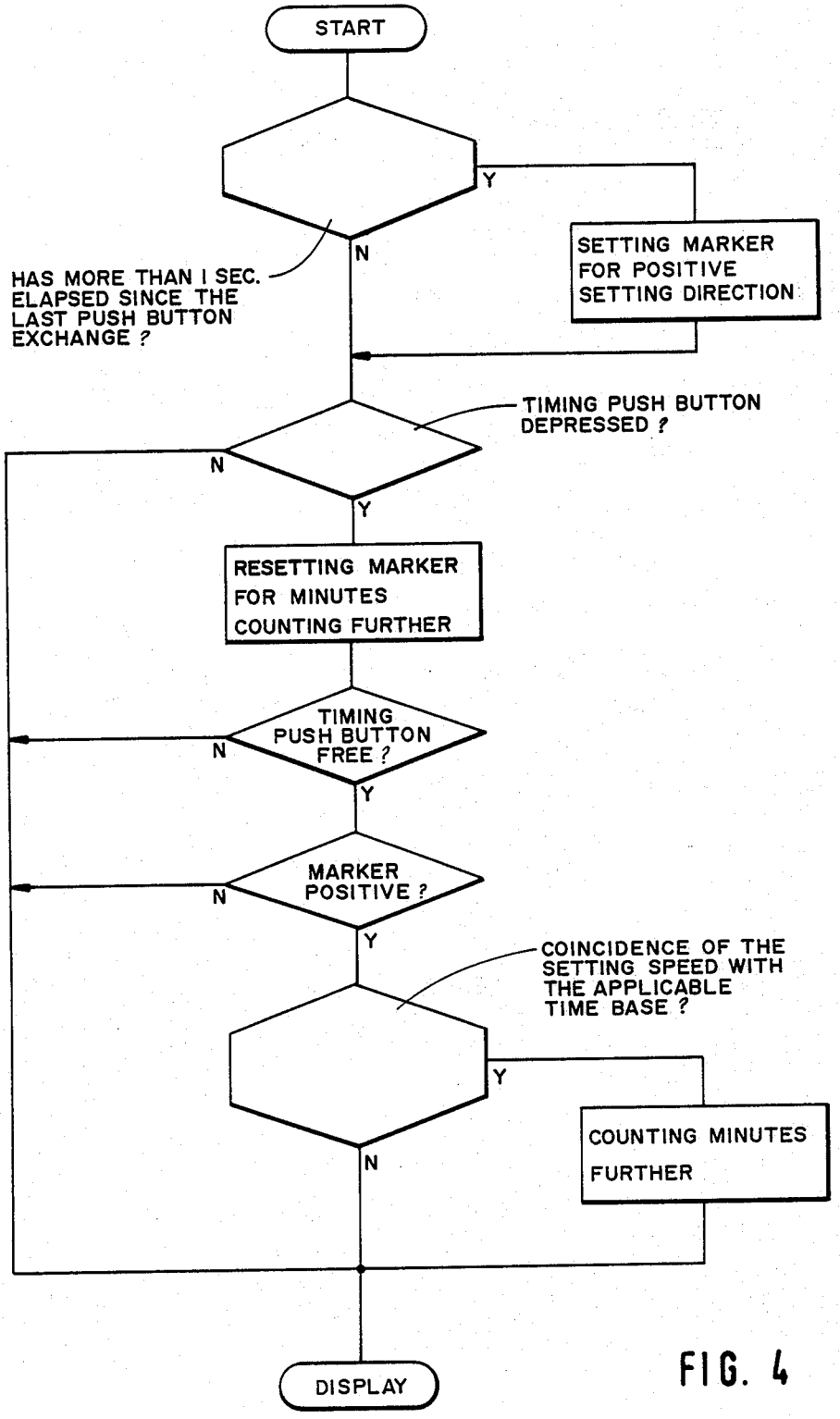
FIG. 4 illustrates a flow chart with respect to the setting of the marker for the positive setting of the display of the timepiece.

In FIG. 3 there is illustrated that particular program portion, which is passed through in the microcomputer 6 during a change in the actuation of the timing push button 3, and through which there is assumed a recognition of the positive or the negative setting direction for the digital display. In the microcomputer a test is undertaken as to whether the actuation of the timing push button is longer or shorter than one second, and the time is set to +1 minute or −1 minute. Which particular counting sequences take place within the microcomputer is detailed further hereinbelow on the basis of the representation in FIGS. 5 and 6. In FIG. 4 there is described that specific program portion which passes through each 20 milliseconds in the microcomputer, and which serves for the positioning of the marker for the setting of the digital display in a positive direction. In this program portion, there are initiated the pulses for the further counting of the display in a positive direction.

From the pulse plot of FIG. 5, in the uppermost pulse row (1) there can be ascertained the actuation of the push button; in the following pulse row (2) the internal counting pulses, in the next pulse row (3) the position of the counter for the setting speed and the setting direction, whereby the count condition 0 is associated with the setting in the backward direction. In the pulse row (4) there is represented the setting of the seconds counter, the time discriminator for the actuation of the push button; in the next pulse row (5) the base time in seconds, in the row (6) there is represented an example for an actual time presentation on the digital display in association with the internal pulses.

Figure 5:
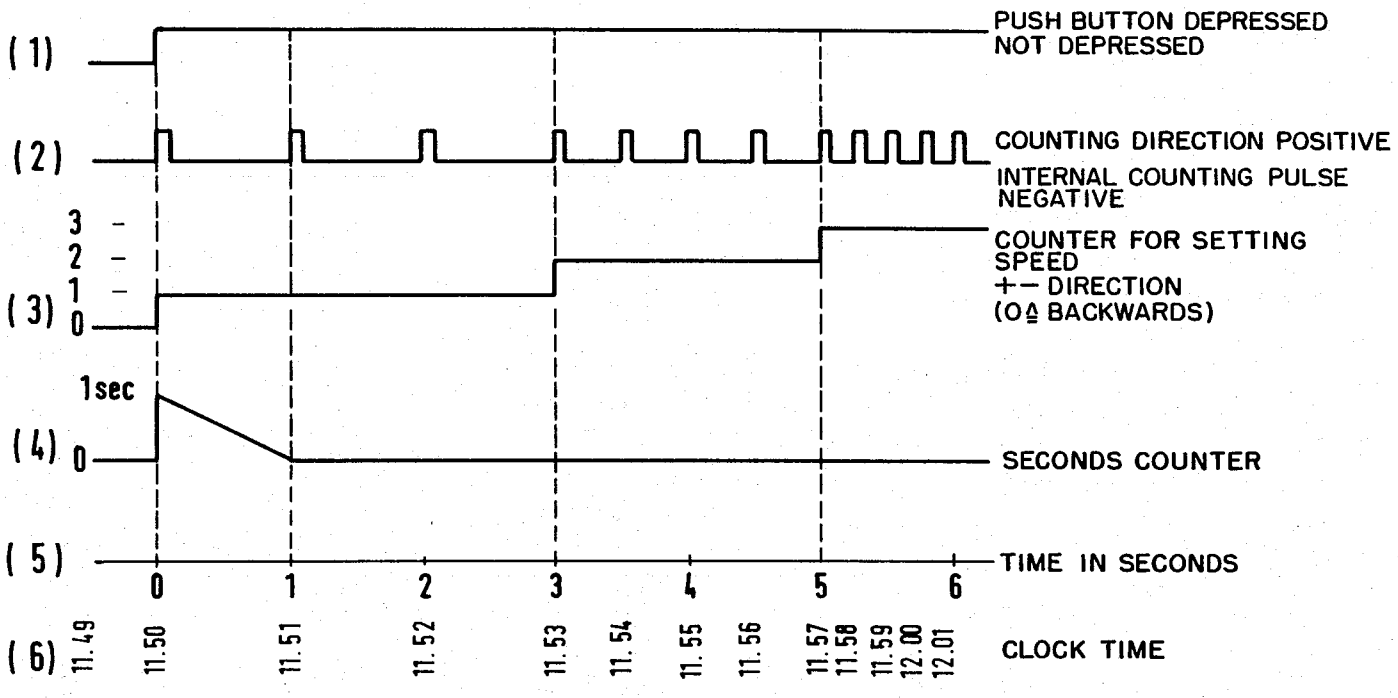
FIG. 5 illustrates a pulse diagram for the setting of the display in a positive or forward direction.

From FIG. 5, row (1) there can be ascertained that at the time point 0 the timing push button 3 is pressed in a continual actuation. In row (4) it can be ascertained that the seconds counter is set to 1 at the time point 0 so as to reduce to the value 0 within a period of one second. This value 0 is characteristic for the setting of the seconds counter during the forward advance or setting of the display, and is maintained for as long as the timing push button 3 is depressed continually or for a period of time of more than one second. From the row (2) there can be ascertained that at the time point 0 there is generated a first internal counting pulse, at the time point 1, and also such pulses as well at the time points 2 and 3. In the row (3) one can ascertain that the counter is initially set in the stage 1, and because of the maintenance of the value 0 of the seconds counter, also remains set at 1.

When the continual actuation takes place for more than three seconds, then, in accordance with row (3), the counter is switched into the stage 2, with the result, that the internal counting pulses pursuant to row (2) are then generated at twice the speed. When the actuation of the timing push button 3 has continued for longer than five seconds, then, pursuant to row (3), the counter is switched over in stage 3 into the next higher setting speed, and the internal counting pulses pursuant to row (2) will now appear at a clearly higher frequency.

Each internal counting pulse has a setting of the display by one minute associated therewith, as can be ascertained from row (6). Overall, (in total), in the exemplary embodiment of the invention, there are provided 6 increments in the setting speed, as is represented by the following tabulation.

| Setting Speed Increment | Actuation of the Timing Push button (time in seconds) | 1 internal counting pulse for each |
|---|---|---|
| 1 | 0–3 | 1 sec |
| 2 | 3–5 | ½ sec |
| 3 | 5–8 | 1/10 sec |
| 4 | 8–10 | 1/25 sec |
| 5 | 10–13 | 1/50 sec |
| 6 | from 13 | 1/50 sec<br>2 Counting pulses |

Figure 6:
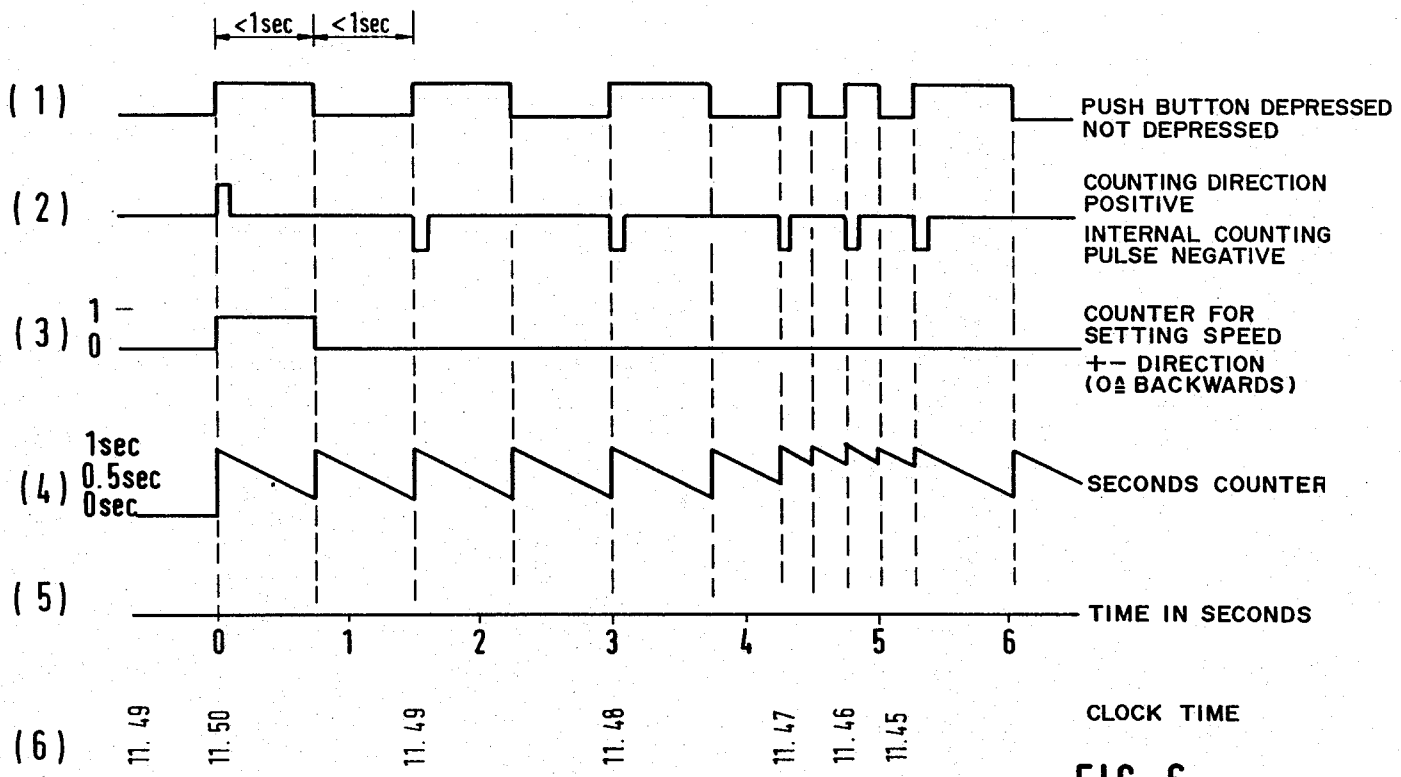
FIG. 6 illustrates a pulse diagram for the setting of the display in a negative or backward direction.
Figure 7:
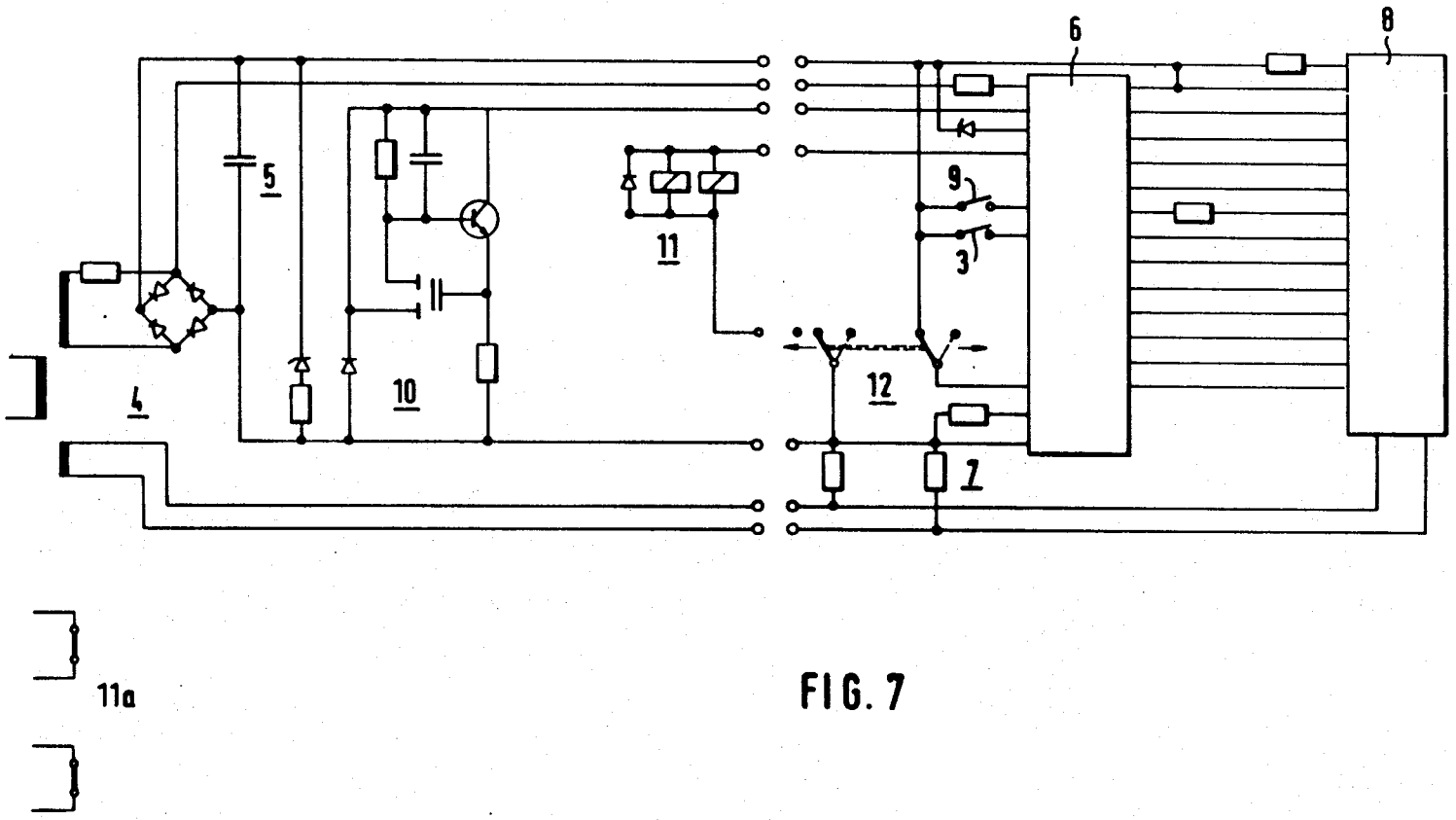
FIG. 7 illustrates a circuit diagram for an electronic cooking range timer.

In FIG. 6 there is illustrated a pulse plot with the same rows (1) through (6) as in FIG. 5; however, for the case of the time setting in the backwards direction. It is ascertainable that the actuation of the timing push button 3 presently has a duration of less than one second, and also the actuating interval is presently less than one second. In the right hand portion of the row (1) there can be ascertained an increase or rise in the actuating sequence of the timing push button with a corresponding increase in the counting speed of the display.

From row (1) it is ascertainable that at the first pushing against the push button 3, there is generated a positive internal counting pulse, inasmuch as the microcomputer at this time does not yet have any knowledge as to whether this relates to a longer applied or to a shorter actuation of the timing push button. From row (4) there can be ascertained that, at the point in time 0, the seconds counter is set to 1; however, because of the shorter actuating period of the timing push button, the counter is not yet counted back to 0 at the pressure on the push button. Thereby, the counter, referring to row (3), which initially was set to 1, is again set back to 0 for the adjusting speed, and remains at this value as long as the seconds counter has not again reached the value 0. This signifies that, after the completion of the actuating interval, after first pressure on the push button there is generated a first internal counting pulse, referring to row (2). At all further pressures on the push button, through which there is fulfilled the requirement that the actuating period and the actuating interval are each less than one second, there is generated a new, negative, internal counting pulse, and as can be seen from row (6), the digital display, which by means of the very first pulse was initially increased by 1, is now constantly set back by respectively one minute.

In FIG. 4 there is also finally described an electronic cooking range timer, in which the invention is implemented. Recognized in an analog manner to the block circuit diagram of FIG. 2, is a power supply 4, a stabilizing circuit 5, a microcomputer 6, which is constructed in accordance with the specifications of a customer, the external circuitry for an oscillator 7, as well as a display 8. In addition to the timing push button 3 there is provided a further actuator or push button 9 for the preselection of different setting criteria for the cooking range timer.

Through the utilization of this push button 9, in addition to the preselection of the setting of the time of day, there can also be preselected a short-term timer (microchronometer), a cooking period, the starting of a cooking period, or the termination of a cooking period, and through the intermediary of the timing push button 3 there can assumed than be undertaken the applicable display settings. The oscillator for the microchronometer (short-term timer) is designated with numeral 10, the switching relay for the circuit of the cooking plates or for the roasting oven are designated by reference numeral 11, and their switch contacts by reference numeral 11*a*. Finally, there is also provided a reversing switch 12 which facilitates, in a known manner, the switching over of the cooking range timer to automatic or to manual operation. During manual operation, the selected cooking plate is immediately heated and switched off at a predetermined point in time, whereas in contrast therewith, during automatic operation the cooking plate is only switched on at a preselected time point and then again switched off at a preselected later point in time.

The setting of the digital display of the cooking range timer on which, in addition to the display it is also possible to provide the time of day, as well as the display of a short time or a cooking period or the start of a cooking period or the end of a cooking period, is effected in the manner as already previously explained in detail.

What is claimed is:

1. In an electronic timepiece with a digital display and an arrangement for the adjustment or setting of the minute and/or hour display through a short or lengthier depression of a push button; the improvement comprising a single timing push button on the timepiece for the selective forward and backward resetting of the display, said single timing push button providing for a rapid setting of the display, such that said arrangement distinguishes between a short depression of the timing push button ($t<t_1$) and a lengthier depression of the push button ($t>t_1$) to cause a backward or forward resetting, respectively, wherein the arrangement assumes a backward setting of the display only when the push button is initially depressed for a short period ($t<t_1$), and depressed for a subsequent pulse interval similarly for a short period ($t<t_1$), and wherein the arrangement assumes a forward setting of the display when the timing push button is depressed for a lengthier period ($t>t_1$), and upon a continual actuation of the timing push button, assumes after a predetermined time period ($t>n.t_1$) a rapid setting of the display in a plurality of speed increments.

2. An electronic timepiece as claimed in claim 1, wherein said arrangement comprises a microcomputer which conducts two counting routines leading to the setting of the display, one said count routine serving as a time discriminator, and which after a depression of the push button, presently counts from a value $t_1$ to "0", wherein the second counting routine counts from "0" to "1" or r."1", in which the condition "0" is associated with backward setting, the condition "1" with the slow forward setting, and the condition r."1" with the speed increment r for the rapid setting.

3. An electronic timepiece as claimed in claim 1, wherein a predetermined time period $t_1$ for discriminating between a short and lengthier push button pressure is defined by $t_1=1$ second.

4. An electronic timepiece as claimed in claim 1, wherein the timepiece comprises a timer, particular a cooking range timer.

5. An electronic timepiece as claimed in claim 4, wherein the timer, when comprising a cooking range timer, includes in addition to the timing push button for the setting of the display, a further push button for the preselection of the setting criteria such as time of day, cooking and roasting periods, end of cooking time, and short-term timing.

* * * * *